United States Patent [19]

Koch

[11] 4,316,873

[45] Feb. 23, 1982

[54] APPARATUS FOR CONVERTING COAL TO HYDROCARBONS BY HYDROGENATION

[75] Inventor: Klaus Koch, Laatzen, Fed. Rep. of Germany

[73] Assignee: Hermann Berstorff Maschinenbau GmbH, Hanover, Fed. Rep. of Germany

[21] Appl. No.: 151,827

[22] Filed: May 21, 1980

[30] Foreign Application Priority Data

Oct. 27, 1979 [DE] Fed. Rep. of Germany ..... 2943537

[51] Int. Cl.[3] ..... B01F 7/08

[52] U.S. Cl. ..... 422/112; 422/205; 422/229; 422/233

[58] Field of Search ..... B01J/8/10; C10G/1/06; 422/205, 208, 226, 229, 233, 236, 112; 208/8 R, 8 LE; 201/33, 36; 202/108, 118, 134, 135, 262, 265, 266, 269

[56] References Cited

U.S. PATENT DOCUMENTS

| | | | |
|---|---|---|---|
| 2,976,131 | 3/1961 | Milne | 422/226 |
| 3,030,297 | 4/1962 | Schroeder | 208/8 R |
| 3,658,654 | 4/1972 | Gutberlet | 202/118 |
| 4,087,334 | 5/1978 | Harig et al. | 202/269 |
| 4,106,997 | 8/1978 | Kevorkian et al. | 202/118 |
| 4,162,957 | 7/1979 | Leonard | 208/8 LE |
| 4,206,713 | 6/1980 | Ryason | 202/118 |
| 4,250,015 | 2/1981 | Yang et al. | 422/208 |

FOREIGN PATENT DOCUMENTS 2723457 12/1977 Fed. Rep. of Germany .

*Primary Examiner*—Bradley Garris

*Attorney, Agent, or Firm*—Schwartz, Jeffery, Schwaab, Mack, Blumenthal & Koch

[57] ABSTRACT

A method and apparatus for converting, i.e. hydrogenating, dry particles of coal with hydrogen to give hydrocarbons such as engine or heating fuels. The invention combines together several steps in the hydrogenation process, such as compressing the dry coal, heating, plasticized and hydrogenating, in one apparatus. The apparatus comprises a housing, preferably a cylinder containing a feed and preparation portion of a chamber with a rotatable friction element therein and an immediately adjoining hydrogenation portion of the chamber with a rotating rotor therein and with static mixing nozzles projecting thereinto, through which nozzles heated hydrogen can be injected into the coal which has been brought, by the friction element into a heated, plastic state. The friction element and rotor can be driven by a single drive means, the feed and preparation portion of the chamber can be fed with coal from a hopper through a wheel lock and the hydrocarbon products can be ejected through a valve into a separator.

17 Claims, 8 Drawing Figures

APPARATUS FOR CONVERTING COAL TO HYDROCARBONS BY HYDROGENATION

The invention relates to a method and apparatus for converting, using hydrogen, coal to hydrocarbons by hydrogenation.

A broad field of prior art is known in respect of both methods and apparatus for converting coal to hydrocarbons by high pressure hydrogenation. Apparatus for high pressure hydrogenation usually operates by first producing a coal pulp comprising crushed coal and mixing oil. The pulp is fed to a pre-heater, after which it passes into a reactor together with the paste-forming oil or mixing oil, which is added only to enable the coal to be pumped. The reaction products thereafter pass into a hot separator and units which continue the process.

The main disadvantage of a coal hydrogenating plant of this kind is that the pre-heater, which usually comprises coils of piping embedded in a metal block and electrically heated, becomes clogged with coking products.

The previously proposed installations further comprise many separate units interconnected by pipe and valve systems. For this reason too a large amount of trouble has to be expected in operation. The coal particles mixed with a paste forming oil and the hydrogenation products themselves are at very high pressures, up to 500 bars, and high temperatures, up to 500° C. It is obvious that under such conditions products can only be conveyed from one unit to another by very expensive, specialized equipment.

Other hydrogenation processes have been proposed, operating without any so-called paste forming or mixing oil. Published German specification No. 2,723,457, for example, describes a method and apparatus for hydrogenating coal, starting with particles of dry coal. To enable a hydrogenation product to be obtained from dry particles of coal, however, an injector system on the rocket drive mechanism principle is used in this case. Many disadvantages of the prior art can indeed be avoided by using such a method and the appropriate reactor, but the installation itself is extremely complicated and therefore very liable to trouble in operation and expensive in manufacture, which means that the hydrogenation products prepared have to carry high costs.

The invention has among its objects to provide a method and apparatus for converting coal into hydrocarbons by hydrogenation, whereby the steps of compressing, heating, plasticized and hydrogenating can be carried out inexpensively in one piece of apparatus.

The invention also aims to provide a method and apparatus for converting, using hydrogen, coal into hydrocarbons which can be carried out with dry coal particles, without the disadvantages of paste-forming oil, which apparatus can be constructed cheaply and be of compact form.

According to one aspect of the invention, there is provided a method of converting, using hydrogen, coal to hydrocarbons, comprising feeding dry particles of coal in the form of powder or pieces continuously into a chamber from a pressure-sealed volume-controlled dispenser, compressing the particles of coal in the chamber and continuously converting them into a plastic state by frictional heat, subjecting the plastic coal in the chamber to intensive motion and impinging upon it with hydrogen to cause distribution, dispersion and hydrogenation and feeding the plastic and gaseous hydrogenation products continuously to a hot separator.

According to another aspect of the invention, there is provided apparatus for converting, using hydrogen, coal to hydrocarbons, comprising a pressure-sealed volume-controlled dispenser, a chamber into which dry particles of coal can be fed from the dispenser, the chamber comprising a feed and preparation portion and a hydrogenation portion, a friction element in the feed and preparation portion of the chamber to compress the coal and convert it into a plastic state by frictional heat and a rotor and static mixing nozzles in the hydrogenation portion of the chamber.

By feeding dry particles of coal into the feed and preparation portion of the chamber by means of the pressure-sealed volume-controlled dispenser, an initial pressure can be built up even in the feed and preparation portion of the chamber, which initial pressure can considerably accelerate the compressing process and the heating process by means of frictional heat. The pressure is prevented from spreading from the feed and preparation portion of the chamber to the dispenser.

Since dry coal particles with a relatively high bulk weight can be fed in, the compressing of the particles can provide a pre-requisite for the next step in the method, namely the heating by friction.

Intensive shearing, can cause internal friction of the individual particles of coal resulting in rapid heating of the particles.

The quantity of frictional heat transferred to the coal depends on the geometrical formation of the friction element and the induced drive power transferred to the coal material by the rotating friction element. The faster the friction element turns the more rapidly the coal particles are converted to the plastic state and conveyed into the hydrogenation portion of the chamber.

When the friction treatment applied to the compressed particles of coal enables the agglomerating or plasticizing temperature to be reached (this may be from 350°–450° C. depending on the type of coal) the fluid, heated hydrogen is injected. This is accompanied by intensive eddying of the plasticized coal, i.e. intensive distribution and dispersion or spreading out.

When the heated hydrogen comes into contact with the high-temperature, plasticized coal, hydrocarbons of different valencies will be formed according to the conditions of the process (pressure, temperature, residence time) in an exothermic reaction.

The fact that the hot hydrogen injected strikes the very finely distributed coal in motion and strikes the whole content of the hydrogenation portion of the chamber almost simultaneously can ensure extremely rapid conversion, i.e. hydrogenation, to hydrocarbon, and the apparatus therefore can achieve a very high output.

The plastic and gaseous hydrogenation products can thereafter be fed continuously to a hot or cold separator and, according to their character, are further processed into engine or heating fuel.

The feed and preparation portion of the chamber in which the dry coal particles are compressed is preferably cylindrical and the rotating friction element exerts a conveying action and heats the coal to hydrogenating temperature by frictional heat. The material then passes into the hydrogenation portion of the chamber which is also preferably cylindrical and adjoins the preparation chamber without any transition.

The hydrogenation portion of the chamber contains the rotating rotor, which rotor has vanes and is secured against relative rotation with respect to the friction element. The static mixing nozzles are preferably of different lengths and project into the hydrogenation portion of the chamber, ensuring that the hydrogen will be ejected in different planes and thus uniformly throughout the volume of the hydrogenation portion of the chamber. The speed of hydrogenation and the output of the apparatus can be controlled dependent on the peripheral speed of the rotor and of the friction element connected thereto.

By providing the hydrogenating portion of the chamber and the feed and preparation portion of the chamber in a single housing, it becomes possible to carry out the compressing step, the heating process, the plasticized process and even the hydrogenating process in one piece of apparatus, thereby eliminating many of the sources of trouble experienced in prior art apparatus.

For example it is no longer necessary for the dry coal particles to be pre-heated in a separate apparatus as in U.S. Pat. No. 3,030,297 and fed into a pipe by means of a further machine, namely a conveyor, and for the pre-heated carbon particles in the pipe to be further heated by heated hydrogen and conveyed into the pre-heater. Since the heating in the pre-heater and in the reactor, which can be equated with the chamber of this invention, is carried out by means of coiled pipes which are taken through in a helical or cage shaped arrangement and to which heat is applied, the danger of these coiled pipes, carrying the coal particles and hydrogen, coking up is particularly great because heating to hydrogenating temperature is effected by heat conduction. Furthermore there is a danger of the valves and pipes becoming clogged.

In the apparatus of this invention the combination of the steps necessary for the hydrogenation process and the processing conditions which become necessary, in one machine unit accommodated in a single chamber, thus can avoid the aggravating disadvantages of prior art.

Since the apparatus can have a considerable output despite the appreciable reduction in the number of pieces of apparatus, because a positive and controllable eddying speed for the coal with the hot hydrogen is produced in the hydrogenating chamber, i.e. the reactor, the installation can be very economical.

Separate drives for the friction element and the rotor can be provided if desired in order that the respective peripheral speeds can be adapted to different grades of coal.

If two drives are used, it is possible to arrange the hydrogenation portion of the chamber at right angles to the feed and preparation portion of the chamber but with the two portions still in one housing.

Using a friction element and a rotor turning in a cylinder can give a machine which is very robust and durable, less expensive and also less subject to trouble. This becomes particularly clear in a comparison with the machines formerly employed for carrying out the component processes, such as mixing units, piston pumps and preliminary heaters which were very liable to trouble.

Units rotating in cylinders are far safer and more readily controlled from the engineering point of view.

The invention is diagrammatically illustrated by way of example in the accompanying drawings, in which.

Figure 1:
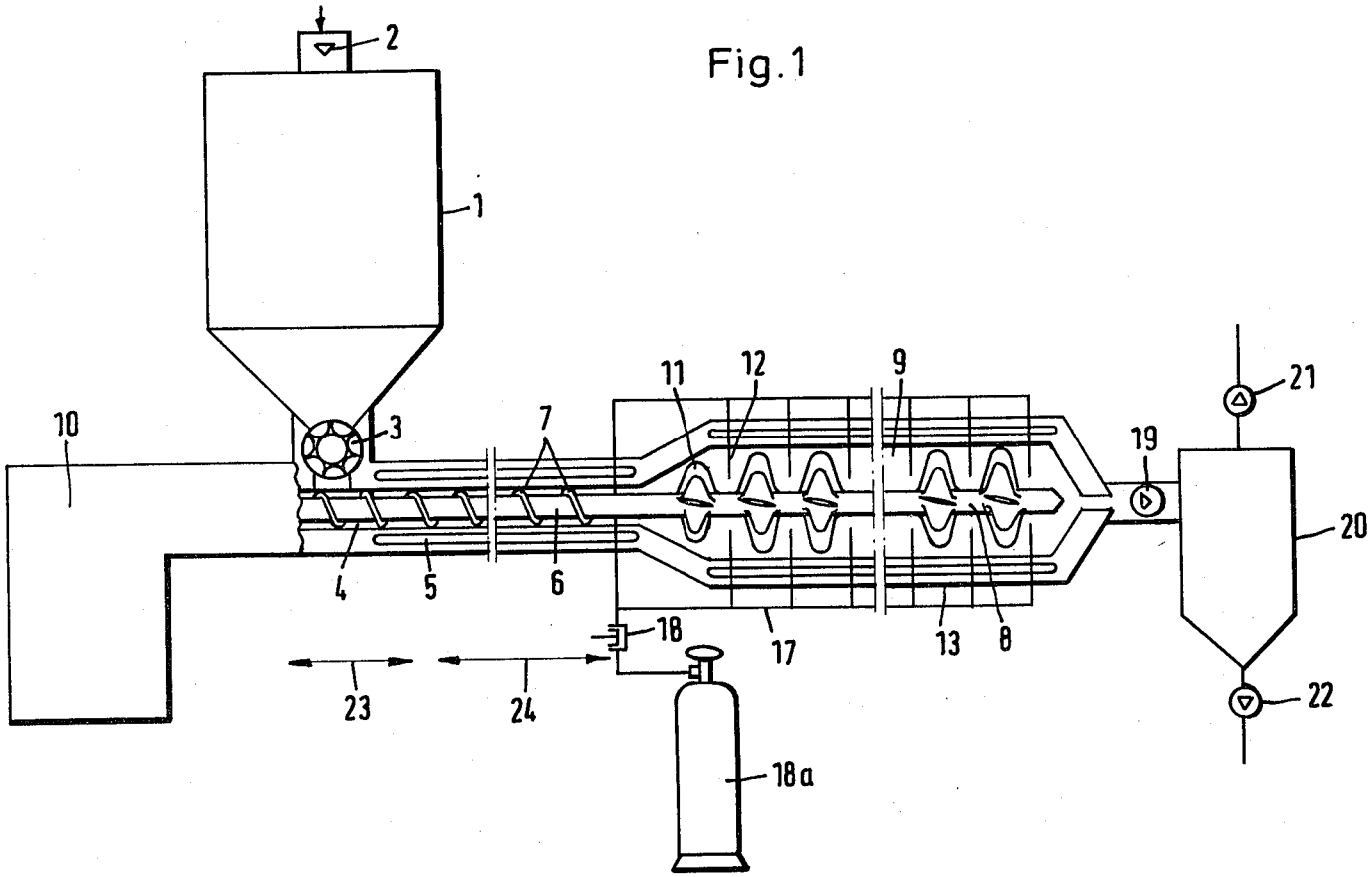
FIG. 1 is a longitudinal section through hydrogenating apparatus according to the invention, including a pressure-sealed feed hopper and a hot separator.

Referring to the drawings, and firstly to FIGS. 1 to 5, apparatus for converting coal to hydrocarbons with hydrogen, comprises a pressure-sealable feed hopper 1 which is closed at its top end by a valve 2. At the bottom end of the hopper 1 there is a cellular wheel lock 3 which shuts off the hopper 1 from a feed and preparation portion 4 of a chamber.

The feed and preparation portion 4 is formed by a cylinder 4*a* (FIG. 2) with tempering passages 5 extending in a longitudinal or radial direction therein. A circulating heating or cooling medium may be applied to the passages 5 by means of a tempering system (not shown).

In the feed and preparation portion 4 there is a friction element 6 carrying friction webs 7 in a helical arrangement. The angle of the web 7 i.e. the lead angle between a vertical and the axis of the friction element, is chosen according to the conveying speed desired.

The pitch width 7*f*, i.e. the spacing between adjacent friction webs 7, is chosen according to the size of the coal particles to be hydrogenated or to the viscosity of decomposed coal paste to be used. It is also possible to vary the pitch depth between the individual friction webs 7, e.g. to allow for control of pressure in the feed and preparation portion 4 at the downstream end thereof. As the pitch depth and pitch width 7*f* are reduced there is an increasing build-up of pressure from a pressure build-up region 23 to a friction region 24 towards a hydrogenation portion 9 of the chamber.

The friction element 6 and a rotor 8, secured against rotation with respect thereto and located in the hydrogenation portion 9 of the chamber are set in rotation by drive means 10, which will not be described in detail.

Figure 2:
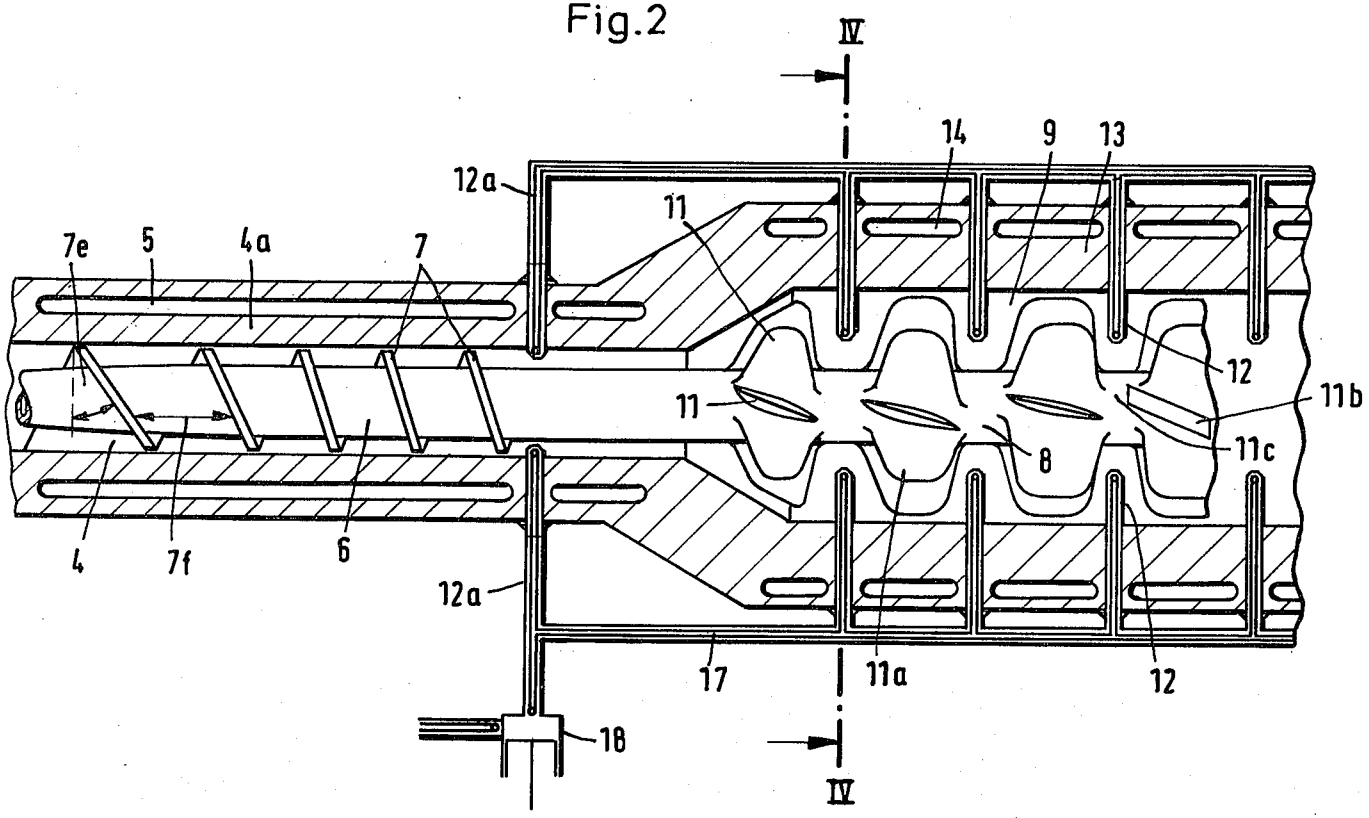
FIG. 2 is a longitudinal section through part of a feed and preparation portion and a hydrogenation portion of a chamber of the apparatus of FIG. 1 with a friction element and a rotor disposed therein.

The rotor 8 in the hydrogenation portion 9 has vanes 11 thereon. These may be arranged obliquely to the axis of the rotor 8, to produce a conveying action in the chamber 9. FIG. 2 of the drawings shows spoon-like vanes 11. However, the vanes could be constructed differently, e.g. in the form of coiled webs 11*b* on the rotor 8, which are interrupted at positions 11*c*, where static mixing nozzles 12 project into the portion 9 of the chamber.

The hydrogenation portion 9 is formed by a cylinder 13 which has integral tempering passages 14. The passages 14 may extend around the cylinder 13 in a radial direction or may extend axially. A tempering system which will not be further explained is connected to the passages 14. This system allows for steplessly adjustable tempering, that is to say, for heating the cylinder 13 when the installation is being started up and for cooling it during subsequent operation.

The static mixing nozzles 12 project into the hydrogenation portion 9 and fulfil two functions. The nozzles 12 are disposed between the rotor vanes 11 in such a way that they reach the rotor 8. The vanes 11 impart a conveying movement to the material, which is thus acted upon by the following row of static mixing nozzles 12 and subjected to intensive mixing and eddying. A succeeding row 11*a* of vanes then picks up the stream of material, and the intensive mixing and shearing movements are repeated.

In addition to their mixing function the nozzles 12 have the function of feeding hydrogen to the portion 9 of the chamber. Thus passages 15 (FIGS. 3 and 4) are provided in the nozzles 12, the passages 15 being closed at the end and also at the side half way along the length by non-return valves 16 and being connected to a hydrogen supply system 17. The system 17 is connected to a compressor 18 and a hydrogen source 18*a*, whereby hydrogen is forced into the portion 9 of the chamber under pressure.

The portion 9 is closed at its downstream end by a valve 19 which opens when a pre-selected pressure is exceeded. When the hydrogenation products have passed through the valve 19 they enter a hot separator 20, which can be closed by means of valves 21 and 22.

The operation of the apparatus for converting coal into hydrocarbons with hydrogen, will now be described.

Coal is fed into the hopper 1 in the form of powder or pieces. The valve 2 in the hopper is closed and pressure builds up. The coal in powder or piece form passes into the feed and preparation portion 4 through the cellular wheel lock 3. Care must of course be taken to ensure that bridges do not form in the hopper 1 and cause trouble. For this purpose agitating elements (not shown) are preferably fitted in the hopper 1 to keep the contents of the hopper 1 constantly in motion. To allow for continuous operation a second feed hopper can be provided, its valves and feed to the feed and preparation portion 4 being switched over when the first hopper has been emptied.

The cellular wheel lock 3 enables controlled quantities of the pieces of coal to be fed into the feed and preparation portion 4 of the chamber. At the same time it ensures that the pressure prevailing in the feed portion 4 cannot spread into the hopper 1.

In the feed portion 4, which is divided into two regions, namely the pressure build-up region 23 and the friction region 24, the coal is moved towards the hydrogenation portion 9 of the chamber by the rotating friction element 6. The material is constantly compressed by the friction webs on the friction element 6, which webs define a passage between them. The rotating movement of the element 6 conveys the pieces of coal by means of the conveying side faces of the webs 7 towards the hydrogenation portion 9. The coal particles are thus subjected to a shearing movement by the webs 7, thereby generating frictional heat and increasingly agglomerating them. The particles pass from their powder or piece form into an agglomerated state and from there into a plastic state as a result of the increasing shearing action.

Figure 5:
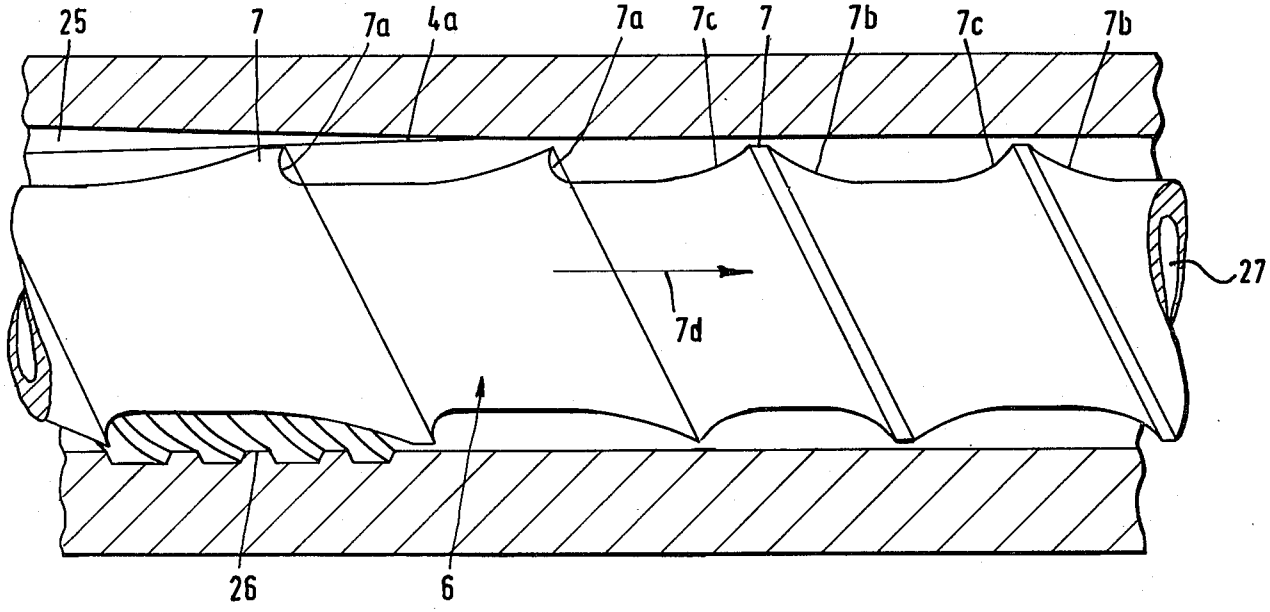
FIG. 5 is a longitudinal section through a different embodiment of a friction element for apparatus according to the invention.

The frictional element 6 is preferably constructed as described below and shown in FIG. 5. In the pressure build-up region 23 the friction webs 7 may have a pocket-like undercut 7*a*, to allow for conveying without great friction losses and thus for a build-up of pressure in the direction of arrow 7*d*.

The webs 7 provided with undercuts 7*a* extend approximately into the region where adequate pressure is reached in the feed and preparation portion of the chamber, and into the region where the aggregate state of the coal is converted into paste form or into a plastic phase.

In the friction region 24 the webs 7 may be provided with inclined portions 7*b* and 7*c* on both sides, so that they preponderantly exert a rubbing action on the coal particles or on the plastic phase of the coal.

The rubbing action of the inclined portions 7*b* and 7*c* generates considerable frictional heat to raise the temperature of the coal in paste or plastic form.

It is also important that, once the coal has become pasty or plastic, it should adhere to the inner wall of the cylinder 4*a* and be removed therefrom by the rotating movement of the friction element 6, through the conveying action of the web sides 7*a*, 7*b*. In this way a large amount of frictional heat is transferred to the coal, thereby aiding in rapid and very strong internal heating.

The conversion of the aggregate state of the coal from the piece or powder form to the plastic form is assisted during a starting-up phase of the installation by heating the cylinder 4*a* of the portion 4 by means of a tempering medium which circulates in the tempering passages 5. This enables the installation to be brought rapidly to its operating temperature.

To accelerate the hydrogenation process hydrogen may be fed into the coal even at the end of the feed and preparation portion 4. The coal will be plastic by then and be at a temperature of approximately 400° C. and a pressure of approximately 400 bars. For this purpose static mixing nozzles 12*a*, fitted with a non-return valve, extend through the wall of the cylinder 4*a*. The nozzles 12*a* communicate with a hydrogen supply system 17 connected to the compressor 18 and the hydrogen source 18*a*.

The plastic coal, already enriched with hydrogen and brought to a high temperature in the feed and preparation portion 4, is passed into the hydrogenation portion 9 by the conveying action of the friction webs 7. In the portion 9 it is subjected to an intensive mixing and shearing action by the rotor vanes 11 and the static mixing nozzles 12 disposed between the vanes.

Figure 4:
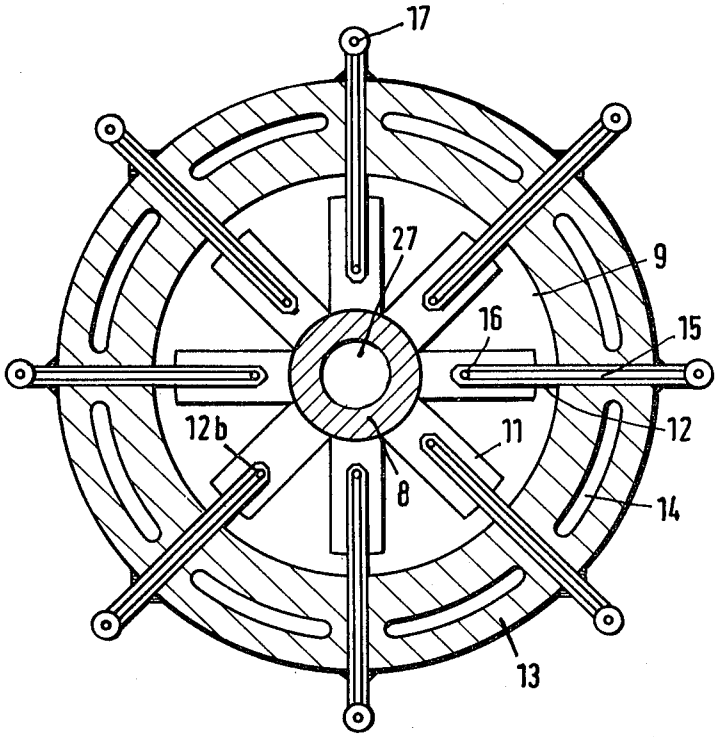
FIG. 4 is a cross-section taken on line IV—IV of FIG. 2, through the hydrogenation portion of the chamber, the static mixing nozzles and the rotor.
Figure 3:
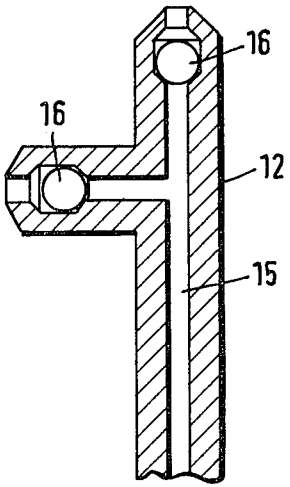
FIG. 3 is a longitudinal section through the chamber end of a static mixing nozzle with non-return valves of the apparatus of FIGS. 1 and 2.

Referring now to FIG. 4, eight vanes 11 are provided on the rotor 8 disposed around its periphery. This number may be increased or reduced depending upon the length and efficiency of the hydrogenation portion of the chamber.

The hydrogen, which is put under very high pressure by the compressor 18, is injected into the portion 9 through all the mixing nozzles 12 simultaneously. The fact that the nozzles project different distances into the portion 9 enables the hydrogen to be injected at many places simultaneously and almost centrally into the portion 9. This allows the hydrogen and plastic coal to be intensively and evenly distributed and dispersed throughout the whole volume of the portion 9, and results in extremely intensive and rapid hydrogenation.

In this connection the term "distribution" refers to mixing of the various components, while the term "dispersion" is used to describe the separation of individual coal particles by rubbing. The dispersion considerably accelerates the splitting up of agglomerated parts of the coal and thus the hydrogenation process. The dispersion and spreading out of the contents of the hydrogenation chamber take place primarily on the inner wall of the cylinder 13.

Since the hydrogenation portion 9 of the chamber is also surrounded by the radial or axial tempering passages 14, additional heat can be supplied from outside while the installation is in its starting phase. The passages 14 are connected to tempering systems (not shown) which provide a circulating tempering action.

Since the hydrogenation reaction in the chamber 9 is exothermic, the tempering passages 14 are switched over when the starting-up time for the installation is over, and are used as cooling passages with a circulating cooling medium to dissipate the heat.

A very high pressure of up to 500 bars is maintained in the feed and preparation portion 4 and in the hydrogenation portion 9. Care must therefore be taken to ensure that the outlet of the portion 9 can be pressure-sealed by means of the valve 19 which will open when a preselected pressure is exceeded. When the hydrogenation products have passed through the valve 19 they enter the hot separator 20, which separates solid from liquid products. The hydrogenation products then undergo further processing in the usual, known manner.

Figure 6:
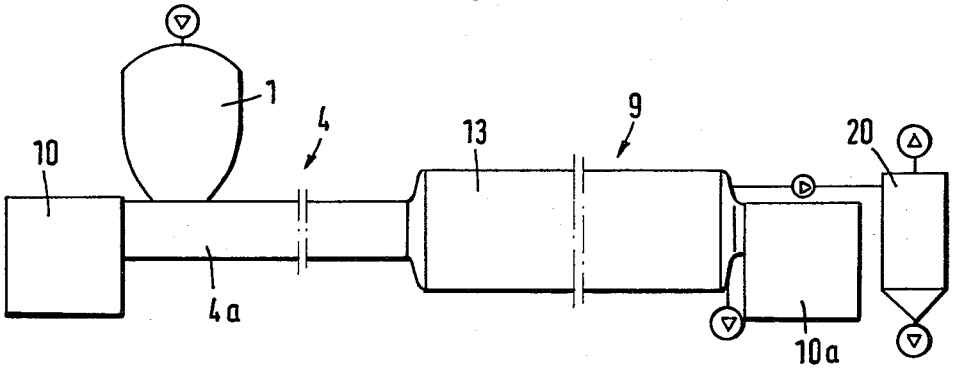
FIGS. 6 and 7 show different arrangements of feed and preparations portions and hydrogenation portions of a chamber of apparatus according to the invention.

To enable the friction element 6 in the feed and preparation portion 4 and the rotor 8 in the hydrogenation portion 9 to be driven at different speeds, the arrangement shown in FIG. 6 can be used, where the portions 4 and 9 are accommodated in a common housing but the drive 10 drives only the friction element 6 and a separate drive 10*a* drives the rotor 8. The friction element 6 and the rotor 8 are either engaged one within the other at their position of contact or run freely centered in the respective cylinders 4*a* and 13. The speed difference is advantageous for hydrogenating charge coal with different properties and hydrocarbon content.

Figure 7:
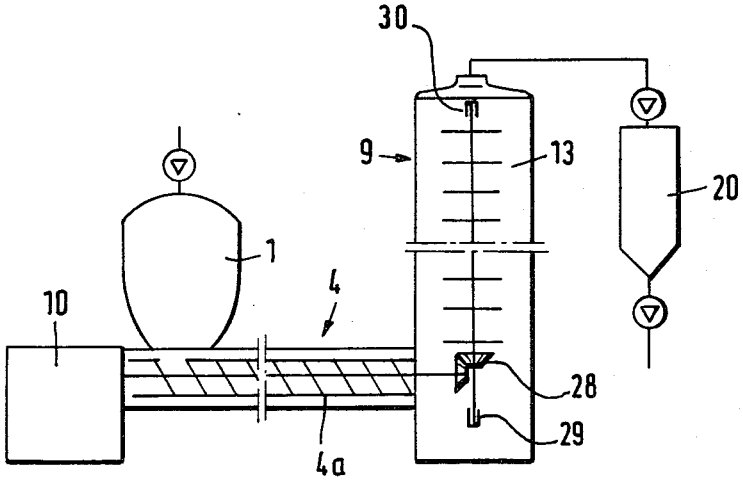

FIG. 7 shows an installation with a vertical hydrogenation portion 9. In this arrangement the friction element in the feed and preparation portion 4 drives the rotor in the hydrogenation portion 9 by means of the bevel gearing 28 indicated. The rotor in the hydrogenation portion 9 is mounted at its ends in bearings 29 and 30. Such a disposition of the hydrogenation portion 9 and the feed and preparation portion 4 can take up very little space and be particularly advantageous in certain cases.

Figure 8:
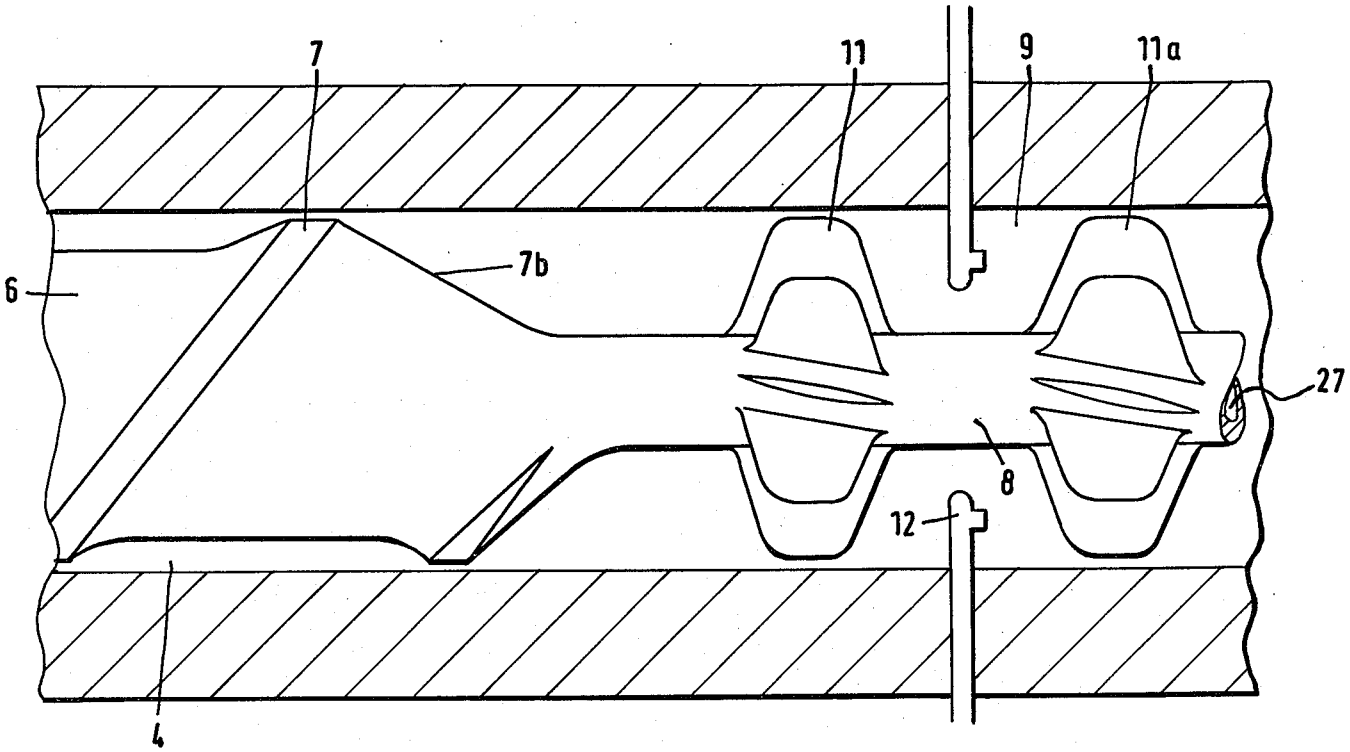
FIG. 8 is a fragmentary longitudinal section through a still further embodiment of apparatus according to the invention.

FIG. 8 shows an embodiment where the portions 9 and 4, arranged in a common housing, are of the same diameter. The advantage of such an embodiment is that a cylinder extending right through the apparatus can be used, this being simpler and cheaper to manufacture than a stepped cylinder.

Providing the internal diameter of the cylinder 13 of the portion 9 twice as large as that of the cylinder 4*a* of the portion 4 has the advantage that the volume in the hydrogenation portion can be up to four times as great, so that the hydrogenating performance in a given time can be quadrupled. However, if the diameters of the portions 4 and 9 are equal as in FIG. 8, it is desirable for the diameter of the shaft of the rotor 8 to be reduced accordingly, in order to have more volume available for carrying out the hydrogenation process. In a preferred embodiment the diameter of the shaft of the rotor 8 in such a case is chosen to be down to half the diameter of the shaft of the friction element 6. The shaft diameter is understood as being the diameter measured without the rotor vanes 11 and without the webs 7 on the friction element 6.

What is claimed is:

1. Apparatus for converting coal to hydrocarbons by the use of hydrogen, comprising:

(a) a pressure-sealed volume-controlled feed hopper for the coal;

(b) a feed and preparation chamber defined by a cylinder and communicating in a controlled manner with said feed hopper, (c) a rotatable friction element mounted in said feed and preparation chamber and functioning to convey, compress and shear the coal thereby generating frictional heat, pressure and agglomeration of the coal, with the coal in such feed and preparation chamber being transformed into a plastic state prior to leaving said feed and preparation chamber, (d) a substantially cylindrical hydrogenation chamber downstream of and in flow communication with said feed and preparation chamber for receiving the plasticized coal, (e) rotor means mounted for rotation in said hydrogenation chamber, said plasticized coal being subjected to intensive mixing and shearing action by said rotor means, and (f) means for injecting hydrogen under high pressure into said hydrogenation chamber, as a result of which the hydrogen and plasticized coal are intensively distributed and dispersed through the hydrogenation chamber, thereby effecting intensive and rapid hydrogenation.

2. Apparatus as claimed in claim 1, wherein a cellular wheel lock is provided to control feed of coal through a feed aperture into said feed and preparation chamber, said friction element has friction webs thereon; said rotor means has vanes thereon; said hydrogenation chamber adjoins said feed and preparation chamber without any transition; said means for injecting hydrogen comprises static mixing nozzles extending through the wall of said hydrogenation chamber and pointing towards the axis of said rotor means, and an outlet from said hydrogenation chamber having valve means positioned therein which opens at a preselected pressure.

3. Apparatus as claimed in claim 2, wherein said vanes of said rotor means are formed by helical friction webs extending around said rotor means and interrupted at dipping positions for said mixing nozzles.

4. Apparatus as claimed in claim 3, wherein the dipping depth of said mixing nozzles through the cylindrical hydrogenation chamber varies.

5. Apparatus as claimed in claim 3, wherein said friction element is constructed with said friction webs thereof of varying pitch.

6. Apparatus as claimed in claim 3, wherein a passage formed between said friction webs on said friction element decreases in cross-section to obtain an increase in pressure in the coal in a direction towards said hydrogenation chamber.

7. Apparatus as claimed in claim 3, wherein in a pressure build-up region of said friction element the sides of said friction webs which have a conveying action are constructed with a pocket-like undercut to generate pressure, and in a friction region said webs are constructed with inclined portions to generate frictional heat.

8. Apparatus as claimed in claim 2, wherein axially or helically extending slots of varying depth and pitch are provided in the inner wall of the cylinder of said feed and preparation chamber in a pressure build-up region thereof below said feed hopper.

9. Apparatus as claimed in claim 1, wherein the internal diameter of the cylinder of said hydrogenation is up to twice as large as that of said feed and preparation chamber.

10. Apparatus as claimed in claim 1, wherein the diameters of said cylindrical hydrogenation chamber and said cylindrical feed and preparation chamber are equal, and the diameter of the shaft of said rotor means is approximately half that of the shaft of said friction element.

11. Apparatus as claimed in claim 1, wherein said friction element and said rotor means are secured against relative rotation and are driven together by drive means the speed of rotation of which is set in a steplessly adjustable manner.

12. Apparatus as claimed in claim 1, wherein said friction element and said rotor means are each equipped with separate drive means to selectively drive the same either at the same or varying speeds.

13. Apparatus as claimed in claim 1, wherein said cylinder of said feed and preparation chamber and said friction element are formed with tempering passages, the passage of said friction element comprising an axially extending tempering passage communicating with an adjoining tempering system.

14. Apparatus as claimed in claim 1, further comprising means for injecting hydrogen into said feed and preparation chamber to facilitate the hydrogenation process.

15. Apparatus as claimed in claim 1, wherein said hydrogenation chamber is disposed with its axis extending at right angles to the axis of said feed and preparation chamber, and said rotor means is mounted and driven by said friction element by means of a bevel gearing.

16. Apparatus as claimed in claim 1, further including tempering passages formed in the cylinders of said feed and preparation chamber and said hydrogenation chamber whereby additional heat can be supplied to said passages when said apparatus is in its starting phase, and coolant can be supplied to said passages to dissipate the heat during the hydrogenation process.

17. Apparatus as claimed in claim 1, wherein said means for injecting hydrogen comprises static mixing nozzles extending through the wall of said hydrogenation chamber and pointing in both radial and axial directions at equally spaced intervals, said nozzles being equipped with non-return valves and communicating with a source of hydrogen under pressure.

* * * * *